US012465820B2

(12) United States Patent
Cleghorn

(10) Patent No.: US 12,465,820 B2
(45) **Date of Patent: *Nov. 11, 2025**

(54) MULTI-MATERIAL GOLF CLUB HEAD

(71) Applicant: Acushnet Company, Fairhaven, MA (US)

(72) Inventor: Richard L. Cleghorn, Oceanside, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/336,247

(22) Filed: Jun. 16, 2023

(65) Prior Publication Data

US 2023/0338787 A1 Oct. 26, 2023

Related U.S. Application Data

(63) Continuation of application No. 18/092,733, filed on Jan. 3, 2023, which is a continuation-in-part of application No. 17/725,075, filed on Apr. 20, 2022, now Pat. No. 12,208,317.

(51) Int. Cl.
*A63B 53/04* (2015.01)

(52) U.S. Cl.
CPC ..... *A63B 53/0437* (2020.08); *A63B 53/0433* (2020.08); *A63B 53/0466* (2013.01)

(58) Field of Classification Search
CPC ..... A63B 53/0437; A63B 53/0466; A63B 53/0433
See application file for complete search history.

(56) References Cited

U.S. PATENT DOCUMENTS

| | | | |
|---|---|---|---|
| 3,985,363 | A | 10/1976 | Jepson |
| 4,076,254 | A | 2/1978 | Nygren |
| 4,139,196 | A | 2/1979 | Riley |
| 4,229,550 | A | 10/1980 | Jones et al. |
| 4,448,941 | A | 5/1984 | Cheung et al. |

(Continued)

FOREIGN PATENT DOCUMENTS

| | | |
|---|---|---|
| CN | 102886130 | 1/2003 |
| CN | 101060892 | 10/2007 |

(Continued)

OTHER PUBLICATIONS

Science Direct, Composites Part B: Engineering, Experimental Investigation of Carbon Fiber Reinforced Poly (phenylene sulfide) Composites Prepared Using a Double-Belt Press, Dong Iiu et al, https://www.sciencedirect.com/science/article/pii/S1359836815001900, Aug. 2015.*

(Continued)

*Primary Examiner* — William M Pierce
(74) *Attorney, Agent, or Firm* — Randy K. Chang

(57) ABSTRACT

A multi-material golf club head wherein the junction between the two different components made from different materials are seamlessly incorporated within existing visual cues of a golf club head is disclosed. More specifically, the present invention adjusts the design of the bond between the two different components to reflect the needs of the golf club head at the various visual cues around the perimeter of the golf club head.

5 Claims, 13 Drawing Sheets

(56) References Cited

U.S. PATENT DOCUMENTS 4,681,322 A 7/1987 Straza et al.
5,058,895 A 10/1991 Igarashi
5,120,062 A 6/1992 Scheie
5,132,178 A 7/1992 Chyung et al.
5,163,682 A 11/1992 Schmidt et al.
5,190,289 A 3/1993 Nagai et al.
5,238,529 A 8/1993 Douglas
5,295,689 A 3/1994 Lundberg
5,310,185 A 5/1994 Viollaz et al.
5,346,216 A 9/1994 Aizawa
5,354,055 A 10/1994 MacKeil
5,358,249 A 10/1994 Mendralla
5,362,055 A 11/1994 Rennie
5,380,010 A 1/1995 Werner
5,385,348 A 1/1995 Wargo
5,403,007 A 4/1995 Chen
5,405,136 A 4/1995 Hardman
5,425,538 A 6/1995 Vincent et al.
5,499,814 A 3/1996 Lu
5,501,459 A * 3/1996 Endo ..... A63B 60/00 473/328
5,524,331 A 6/1996 Pond
5,547,427 A 8/1996 Rigal
5,570,886 A 11/1996 Rigal
5,624,331 A 4/1997 Lo
5,665,014 A 9/1997 Sanford
5,720,673 A 2/1998 Anderson
5,743,813 A 4/1998 Chen et al.
5,839,975 A 11/1998 Lundberg
5,935,020 A 8/1999 Stites et al.
5,967,903 A 10/1999 Cheng
5,997,415 A 12/1999 Wood
6,048,278 A 4/2000 Meyer et al.
6,152,833 A 11/2000 Werner
6,162,133 A 12/2000 Peterson
6,254,494 B1 7/2001 Hasebe et al.
6,299,549 B1 10/2001 Shieh
6,340,337 B2 1/2002 Hasebe et al.
6,354,962 B1 3/2002 Galloway et al.
6,364,788 B1 4/2002 Helmstetter
6,425,832 B2 7/2002 Cackett et al.
6,440,008 B2 8/2002 Murphy et al.
6,454,664 B1 9/2002 Long et al.
6,491,592 B2 12/2002 Cackett
6,530,847 B1 3/2003 Antonious
6,533,681 B2 3/2003 Inoue et al.
6,558,271 B1 5/2003 Beach
6,572,491 B2 6/2003 Hasebe et al.
6,575,845 B2 * 6/2003 Galloway ..... C23F 1/00 473/345
6,605,007 B1 8/2003 Bissonnette et al.
6,617,013 B2 9/2003 Morrison et al.
6,623,378 B2 9/2003 Beach
6,623,543 B1 9/2003 Zeller et al.
6,645,086 B1 * 11/2003 Chen ..... A63B 53/04 473/335
6,669,577 B1 12/2003 Hocknell et al.
6,676,535 B2 1/2004 Sheets et al.
6,776,726 B2 8/2004 Sano
6,837,094 B2 1/2005 Pringle et al.
6,860,823 B2 3/2005 Lee
6,860,824 B2 3/2005 Evans
6,872,152 B2 * 3/2005 Beach ..... B29C 70/46 473/409
6,875,126 B2 * 4/2005 Yabu ..... A63B 53/0466 473/305
6,875,129 B2 4/2005 Erickson et al.
6,945,876 B2 9/2005 Nakahara et al.
6,964,617 B2 11/2005 Williams
7,025,692 B2 * 4/2006 Erickson ..... A63B 60/02 473/335
7,037,214 B2 5/2006 Nakahara et al.
7,056,229 B2 6/2006 Chen
7,063,628 B2 6/2006 Reyes
7,074,136 B2 7/2006 Noguchi et al.
7,108,614 B2 9/2006 Lo
7,128,664 B2 * 10/2006 Onoda ..... A63B 53/0466 473/347
7,137,905 B2 11/2006 Kohno
7,140,974 B2 11/2006 Chao et al.
7,147,572 B2 12/2006 Kohno
7,163,470 B2 1/2007 Galloway
7,166,038 B2 1/2007 Williams
7,258,624 B2 8/2007 Kobayashi
7,267,620 B2 9/2007 Chao et al.
7,281,991 B2 10/2007 Gilbert et al.
7,281,994 B2 10/2007 De Shiell et al.
7,318,782 B2 1/2008 Imamoto
7,331,877 B2 2/2008 Yamaguchi et al.
7,344,452 B2 3/2008 Imamoto
7,347,796 B2 3/2008 Takeda
7,354,353 B2 4/2008 Hocknell et al.
7,361,100 B1 4/2008 Morales
7,422,528 B2 9/2008 Gibbs et al.
7,438,649 B2 10/2008 Ezaki
7,448,964 B2 11/2008 Schweigert
7,497,789 B2 3/2009 Burnett
7,510,485 B2 3/2009 Yamamoto
7,510,486 B2 3/2009 Werner
7,530,903 B2 * 5/2009 Imamoto ..... A63B 60/02 473/335
7,628,712 B2 12/2009 Chao et al.
7,632,193 B2 12/2009 Thielen
7,632,195 B2 12/2009 Jorgensen
7,651,414 B2 1/2010 Rae
7,686,708 B2 3/2010 Morales
7,691,008 B2 4/2010 Oyama
7,704,164 B2 * 4/2010 Beach ..... A63B 53/0466 473/345
7,717,803 B2 5/2010 DiMarco
7,749,103 B2 * 7/2010 Nakano ..... A63B 53/0466 473/345
7,775,905 B2 8/2010 Beach
7,798,203 B2 9/2010 Schweigert
7,806,781 B2 10/2010 Imamoto
7,850,542 B2 12/2010 Cackett
7,861,395 B2 1/2011 Jorgensen
7,867,612 B2 1/2011 Schwung et al.
7,931,546 B2 4/2011 Bennett et al.
7,959,522 B2 * 6/2011 North, III ..... A63B 53/0466 473/324
7,993,216 B2 8/2011 Lee
8,025,591 B2 9/2011 de la Cruz
8,100,781 B2 1/2012 Burnett
8,172,697 B2 5/2012 Cackett
8,197,357 B1 6/2012 Rice
8,221,261 B2 7/2012 Curtis et al.
8,247,062 B2 8/2012 Morrison et al.
8,293,356 B2 10/2012 Merrill et al.
8,308,582 B2 11/2012 Tanimoto
8,419,569 B2 4/2013 Bennett et al.
8,425,349 B2 * 4/2013 Dawson ..... A63B 60/02 473/348
8,444,506 B2 5/2013 Watson
8,460,123 B1 6/2013 DeMille et al.
8,475,292 B2 7/2013 Rahrig et al.
8,496,542 B2 7/2013 Curtis et al.
8,496,544 B2 7/2013 Curtis
8,517,859 B2 8/2013 Golden et al.
8,529,370 B1 * 9/2013 Galloway ..... A63B 53/0466 473/347
8,540,588 B2 9/2013 Rice
8,540,590 B2 9/2013 Tsukada et al.
8,591,353 B1 11/2013 Honea et al.
8,597,139 B2 12/2013 Jorgensen
8,622,847 B2 1/2014 Beach
8,636,608 B2 1/2014 de la Cruz
8,636,610 B2 1/2014 Golden
8,661,879 B2 3/2014 Iwatsubo
8,715,109 B2 5/2014 Bennett et al.
8,753,226 B2 6/2014 Rice
8,758,161 B2 6/2014 Golden et al.
8,777,778 B2 7/2014 Solheim et al.

(56) References Cited

U.S. PATENT DOCUMENTS 8,790,196 B2 7/2014 Solheim et al.
8,814,723 B2 8/2014 Tavares et al.
8,858,362 B1 10/2014 Leposky et al.
8,864,602 B2 10/2014 Curtis et al.
8,876,625 B2 11/2014 Curtis et al.
8,876,629 B2 11/2014 Deshmukh et al.
8,926,450 B2 * 1/2015 Takahashi ..... A63B 53/0466 473/347
8,979,671 B1 3/2015 DeMille et al.
9,033,822 B1 * 5/2015 DeMille ..... A63B 60/00 473/347
9,079,078 B2 7/2015 Greensmith et al.
9,079,089 B2 7/2015 Lokken et al.
9,079,368 B2 7/2015 Tavares et al.
9,101,811 B1 8/2015 Goudarzi et al.
9,174,096 B2 11/2015 Sargent
9,192,831 B2 11/2015 Stites
9,205,312 B2 12/2015 Zimmerman
9,381,410 B2 7/2016 Golden
9,387,373 B1 7/2016 DeMille et al.
9,427,631 B1 * 8/2016 Larson ..... A63B 60/50
9,427,637 B2 8/2016 Beach
9,440,126 B2 9/2016 Boyd
9,498,688 B2 11/2016 Galvan
9,687,700 B2 6/2017 Honea
9,814,954 B2 11/2017 Westrum
9,868,036 B1 1/2018 Kleinert
9,908,014 B1 3/2018 Wester
9,950,222 B2 4/2018 Albertsen
9,968,834 B1 5/2018 Seluga
9,987,533 B2 6/2018 Oldknow
10,065,094 B2 9/2018 Wallin
10,207,160 B2 2/2019 Johnson
10,258,842 B2 * 4/2019 Sander ..... A63B 53/0475
10,293,225 B2 5/2019 Sargent
10,434,380 B2 10/2019 Kawaguchi
10,478,681 B2 11/2019 Franz
10,596,427 B2 * 3/2020 Jertson ..... A63B 53/042
10,603,555 B2 3/2020 Beach
10,617,916 B2 4/2020 Milleman
10,675,514 B2 6/2020 Spackman
10,751,585 B2 * 8/2020 Johnson ..... A63B 53/06
10,799,775 B2 10/2020 Sargent
10,864,413 B2 12/2020 Stokke
10,874,922 B2 * 12/2020 Harbert ..... A63B 53/06
D916,992 S * 4/2021 Bacon ..... D21/752
11,027,178 B2 6/2021 Sugimae
11,040,256 B2 6/2021 Milleman
11,117,026 B2 9/2021 Stokke
11,179,609 B2 * 11/2021 Wester ..... A63B 53/06
11,517,799 B2 * 12/2022 Jertson ..... A63B 53/0437
11,819,743 B2 * 11/2023 Morales ..... A63B 60/02
11,839,802 B2 * 12/2023 Milleman ..... A63B 53/06
11,925,844 B2 * 3/2024 Milleman ..... B32B 25/20
12,208,317 B2 * 1/2025 Cleghorn ..... A63B 53/0437
2001/0049310 A1 * 12/2001 Cheng ..... A63B 60/00 473/345
2002/0019266 A1 * 2/2002 Yabu ..... A63B 53/0466 473/345
2002/0193175 A1 12/2002 Soracco et al.
2004/0005936 A1 * 1/2004 Imamoto ..... A63B 60/02 473/344
2004/0192468 A1 9/2004 Onoda
2005/0020379 A1 * 1/2005 Kumamoto ..... A63B 53/0466 473/332
2005/0043115 A1 * 2/2005 Lin ..... A63B 53/0466 473/345
2005/0090330 A1 * 4/2005 Kumamoto ..... A63B 60/52 473/345
2005/0096154 A1 5/2005 Chen
2005/0119070 A1 * 6/2005 Kumamoto ..... A63B 53/0466 473/345
2005/0143189 A1 6/2005 Lai et al.
2005/0164807 A1 * 7/2005 Liou ..... A63B 53/0466 473/345
2005/0215350 A1 * 9/2005 Reyes ..... A63B 60/00 473/344
2005/0239576 A1 10/2005 Stites
2005/0266933 A1 * 12/2005 Galloway ..... A63B 60/00 473/345
2006/0063608 A1 * 3/2006 Mori ..... A63B 53/0466 473/345
2006/0073910 A1 * 4/2006 Imamoto ..... A63B 60/02 473/345
2006/0100032 A1 * 5/2006 Imamoto ..... A63B 60/02 473/345
2006/0135286 A1 * 6/2006 Imamoto ..... B23K 10/02 473/345
2007/0117650 A1 * 5/2007 Nakano ..... A63B 53/0466 473/345
2008/0139336 A1 6/2008 DiMarco
2008/0139339 A1 * 6/2008 Cheng ..... A63B 53/0466 473/346
2008/0161124 A1 7/2008 Kajita
2009/0088272 A1 4/2009 Foster et al.
2009/0092831 A1 4/2009 Stusgen et al.
2009/0170632 A1 7/2009 Beach et al.
2010/0041494 A1 2/2010 Boyd
2010/0139079 A1 * 6/2010 Dawson ..... A63B 60/00 29/527.5
2011/0224017 A1 9/2011 Thomas
2012/0125073 A1 * 5/2012 Hirano ..... A63B 53/0466 72/379.2
2012/0135821 A1 * 5/2012 Boyd ..... A63B 60/54 473/342
2012/0142451 A1 6/2012 De Shiell
2013/0137531 A1 5/2013 Golden et al.
2013/0217514 A1 * 8/2013 Sugimoto ..... A63B 53/0466 473/345
2013/0252757 A1 9/2013 Deshmukh et al.
2013/0303306 A1 11/2013 Curtis
2013/0331203 A1 * 12/2013 Takahashi ..... A63B 60/02 473/345
2014/0004972 A1 1/2014 Thomas
2014/0038737 A1 2/2014 Roach
2014/0106897 A1 4/2014 Golden et al.
2015/0045134 A1 2/2015 Beno
2015/0108681 A1 4/2015 Deshmukh et al.
2015/0273293 A1 10/2015 Akiyama
2015/0290503 A1 10/2015 Su
2015/0297961 A1 10/2015 Voshall
2015/0298196 A1 10/2015 Su
2015/0335964 A1 11/2015 Sander
2015/0360094 A1 12/2015 Deshmukh
2016/0184666 A1 * 6/2016 Mizutani ..... A63B 53/0466 473/342
2016/0287954 A1 10/2016 Sargent
2016/0332040 A1 * 11/2016 Lafortune ..... A63B 53/0466
2016/0346640 A1 * 12/2016 Boggs ..... A63B 53/0466
2017/0050091 A1 2/2017 Shimahara
2017/0157472 A1 * 6/2017 Frame ..... A63B 53/0466
2017/0259128 A1 9/2017 Greensmith
2019/0022478 A1 1/2019 Greaney
2019/0176001 A1 * 6/2019 Jertson ..... A63B 53/0408
2020/0121999 A1 4/2020 Sargent
2020/0206589 A1 7/2020 Parsons
2021/0138323 A1 5/2021 Harbert
2021/0220709 A1 7/2021 Johnson
2021/0283473 A1 9/2021 Stokke
2022/0088450 A1 * 3/2022 Milleman ..... A63B 53/0408
2023/0027166 A1 * 1/2023 Milleman ..... A63B 53/06

FOREIGN PATENT DOCUMENTS

GB 2450764 7/2009
JP H05-7261 2/1993
JP 11-319166 11/1999
JP 2000-210398 8/2000
JP 2002-239041 8/2002
JP 2003-111874 4/2003

(56) References Cited

FOREIGN PATENT DOCUMENTS

| | | |
|---|---|---|
| JP | 2003-250938 | 9/2003 |
| JP | 2004-159794 | 6/2004 |
| JP | 2004-208728 | 7/2004 |
| JP | 2005-058461 | 3/2005 |
| JP | 2005-323686 | 11/2005 |
| JP | 2005-329154 | 12/2005 |
| JP | 2005-348895 | 12/2005 |
| JP | 2006-020860 | 1/2006 |
| JP | 2008-148762 | 3/2008 |
| JP | 2009-011839 | 1/2009 |
| JP | 2011-253586 | 12/2011 |
| JP | 2014-501167 | 1/2014 |

OTHER PUBLICATIONS

The Royal and Ancient Golf Club of St. Andrews and USGA, Technical Description of the Pendulum Test revised version, Nov. 2003.
Machine Translation of JPH05-7261.
Jackson, Jeff. The Modern Guide to Golf Clubmaking,. Ohio: Dyanacraft Golf Products, Inc. copyright 1994, pp. 236-237.

* cited by examiner

MULTI-MATERIAL GOLF CLUB HEAD

CROSS-REFERENCE TO RELATED APPLICATIONS

The present application is a Continuation (CON) of U.S. patent application Ser. No. 18/092,733, filed on Jan. 3, 2023, which is a Continuation-In-Part (CIP) of U.S. patent application Ser. No. 17/725,075, filed on Apr. 20, 2022, the disclosure of which are both incorporated by reference in their entirety.

FIELD OF THE INVENTION

The present invention relates generally to a multi-material golf club head wherein the junction between the two different components made from different materials are seamlessly incorporated within existing visual cues of a golf club head to provide an aesthetically pleasing joint between the two components. More specifically, the present invention relates to identifying the existing visual cues of a golf club head together with the different bonding needs of the golf club head at the desirable visual cue, and continuously adjusting the design of the joint between the two different components depending on the needs of the golf club head at across the entire junction between the two different components.

BACKGROUND OF THE INVENTION

Utilizing multiple materials to design a golf club head has been around for a long time. U.S. Pat. No. 3,985,363 to Jepson et al. illustrates one of the earliest attempts to utilize multiple materials to improve the performance of a golf club head via the utilization of wood, metal, and plastic.

Despite all of the advantages associated with the utilization of material, two of the biggest drawbacks associated with multi-material golf club head are 1) the difficulties in securely joining materials to withstand the impact forces with a golf ball, and 2) preserving the aesthetics of the golf club to minimize the distractions associated with the differing visuals of the different material.

U.S. Pat. No. 5,385,348 to Wargo illustrates one of the earliest examples of utilizing threaded fasteners to secure a heavy secondary golf club component to the main chassis of the golf club head. U.S. Pat. No. 5,385,348 to Wargo utilizes replaceable inserts that have their weights and characteristics varied by controlling the amount and location of a layer of weightly material attached thereto.

U.S. Pat. No. 7,037,214 to Nakahara et al. illustrates the utilization of a lightweight material to replace the crown portion of a golf club via flanges wherein the ratio of the specific gravities is equal to or superior to 1.3. The bond between a thin crown piece and the chassis of the golf club head creates a unique set of challenges, as lightweight materials tend not to bond well to metallic materials, and the bond usually creates a visual delineation that is undesirable visually.

Hence, based on the above, it can be seen that there is a need in the art for a multi-material golf club head that not only is capable of achieving a secure bond between the different components, there is a need to do it in an aesthetically pleasing way.

BRIEF SUMMARY OF THE INVENTION

One aspect of the present invention is a golf club head comprising of a body portion and a crown portion. The body portion further comprises a striking face, a hosel, and a portion of a sole, wherein the striking face portion defines a forwardmost vertical plane, and wherein the body portion further comprises a recess around a perimeter of the body portion. The crown portion wraps around a skirt of the golf club head forming at least a portion of the sole, wherein the crown portion overlaps the body portion at the recess of the body portion; wherein a forwardmost point of the crown portion is located less than about 17.5 mm away from the forwardmost vertical plane.

In another aspect of the present invention is a golf club head comprising of a body portion and a crown portion. The body portion further comprises a striking face, a hosel, and a portion of a sole, wherein the striking face portion defines a forwardmost vertical plane, and wherein the body portion further comprises a recess around a perimeter of the body portion. The recess further comprises a frontal crown recess, wherein the frontal crown recess defines a crown transition overlap length, a rear sole recess, wherein the rear sole recess defines a rear overlap length, and a hosel portion recess, wherein the hosel portion recess defines a hosel overlap length. The crown portion wraps around a skirt of the golf club head forming at least a portion of the sole, wherein the crown portion overlaps the body portion at the recess of the body portion, and wherein the crown transition overlap length is greater than about 12 mm and less than about 25 mm.

In another aspect of the present invention is a golf club head comprising of a body portion and a crown portion. The body portion further comprises a striking face, a hosel, and a portion of a sole, wherein the striking face portion defines a forwardmost vertical plane, and wherein the body portion further comprises a recess around a perimeter of the body portion. The recess further comprises a frontal crown recess, wherein the frontal crown recess defines a crown transition overlap length, a rear sole recess, wherein the rear sole recess defines a rear overlap length, and a hosel portion recess, wherein the hosel portion recess defines a hosel overlap length. The crown portion wraps around a skirt of the golf club head forming at least a portion of the sole, wherein the crown portion overlaps the body portion at the recess of the body portion, and wherein the crown transition overlap length is greater than about 12 mm and less than about 25 mm, wherein the rear overlap length is less than about 6.5 mm, and the hosel overlap length is greater than about 8 mm.

In some aspects, the techniques described herein relate to a golf club head including: a body portion further including; a main body chassis having an upper hosel opening and a lower hosel opening, wherein said main body chassis forms a striking face portion that defines a forwardmost vertical plane, and wherein said main body chassis further includes a recess around a perimeter of said main body chassis, an upper hosel component adapted to engage said upper hosel opening, and a lower hosel component adapted to engage said lower hosel opening, and a crown portion wrapping around a skirt of said golf club head forming at least a portion of a sole, wherein said crown portion overlaps said body portion at said recess of said body portion, and wherein a forwardmost point of said crown portion is located less than about 17.5 mm away from said forwardmost vertical plane.

In some aspects, the techniques described herein relate to a golf club head including: a body portion further including; a main body chassis having an upper hosel opening and a lower hosel opening, wherein said main body chassis forms a striking face portion that defines a forwardmost vertical plane, and wherein said main body chassis further includes a recess around a perimeter of said main body chassis, said recess further includes; a frontal crown recess, wherein said frontal crown recess defines a crown transition overlap length, a rear sole recess, wherein said rear sole recess defines a rear overlap length, and a hosel portion recess, wherein said hosel portion recess defines a hosel overlap length, and an upper hosel component adapted to engage said upper hosel opening, and a lower hosel component adapted to engage said lower hosel opening, and a crown portion wrapping around a skirt of said golf club head forming at least a portion of said sole, wherein said crown portion overlaps said body portion at said recess of said body portion, and wherein said crown transition overlap length is greater than about 12 mm and less than about 25 mm.

These and other features, aspects and advantages of the present invention will become better understood with reference to the following drawings, description and claims.

BRIEF DESCRIPTION OF THE DRAWINGS

The foregoing and other features and advantages of the invention will be apparent from the following description of the invention as illustrated in the accompanying drawings. The accompanying drawings, which are incorporated herein and form a part of the specification, further serve to explain the principles of the invention and to enable a person skilled in the pertinent art to make and use the invention.

DETAILED DESCRIPTION OF THE INVENTION

The following detailed description describes the best currently contemplated modes of carrying out the invention. The description is not to be taken in a limiting sense but is made merely for the purpose of illustrating the general principles of the invention, since the scope of the invention is best defined by the appended claims.

Various inventive features are described below, and each can be used independently of one another or in combination with other features. However, any single inventive feature may not address any or all of the problems discussed above or may only address one of the problems discussed above. Further, one or more of the problems discussed above may not be fully addressed by any of the features described below.

Figure 1:
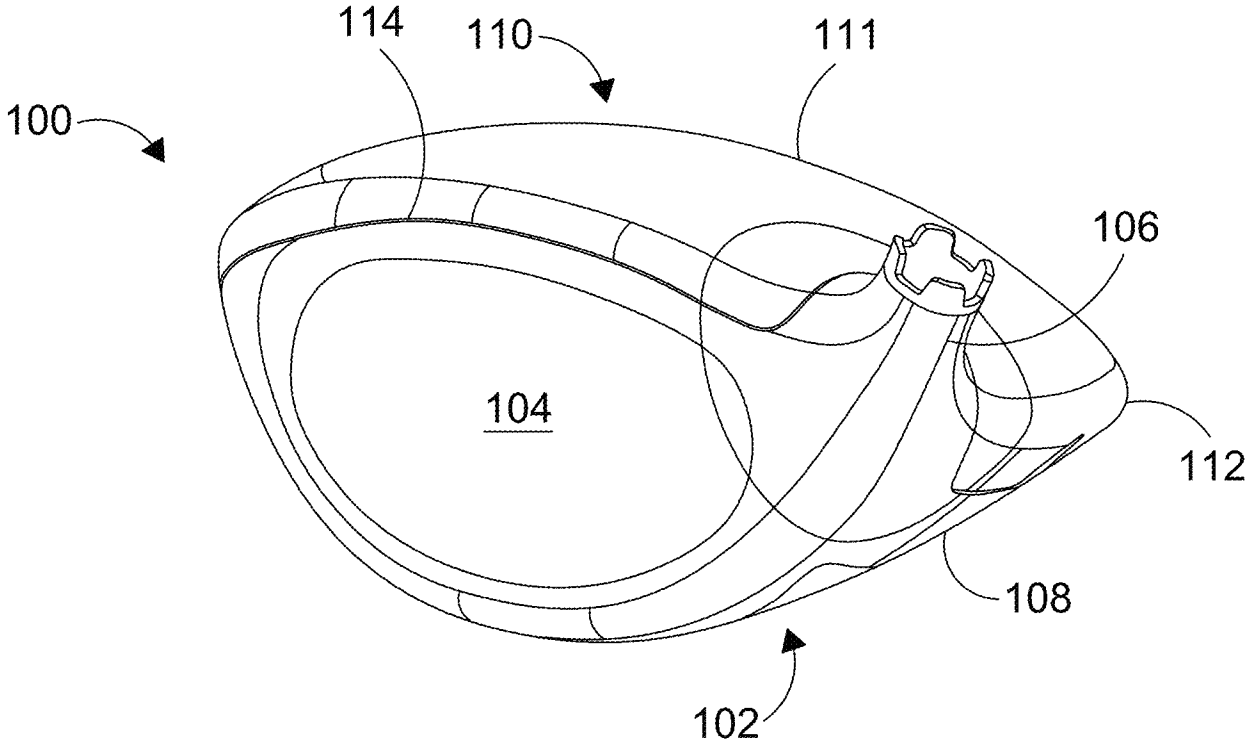
FIG. 1 of the accompanying drawings shows a bottom sole side perspective view of a golf club head in accordance with an exemplary embodiment of the present invention.

FIG. 1 of the accompanying drawings shows a perspective view of a golf club head 100 in accordance with an exemplary embodiment of the present invention. The golf club head 100 if further separated into a body portion 102 and a crown portion 110. The body portion 102 further comprises of sub-components such as the striking face 104, a hosel 106, and a portion of the sole 108. The crown portion 110, in accordance with the current embodiment, includes a crown 111 and wraps around a skirt 112 of the golf club head 100 to form at least a portion of the sole 108.

The body portion 102 of the golf club head 100 in accordance with the present invention may roughly be 4.5 g/cc, as modern day driver type golf club heads are generally made out of a titanium type material; however, numerous other material may be used to form the body portion 102 of the golf club head without departing from the scope and content of the present invention so long as it can provide the structural rigidity of the golf club head 100. The crown portion 110 of the golf club head 100, at least in accordance with the present invention, may generally be made out of a lightweight material such as a fiber reinforced plastic type material with a density of less than about 2.0 g/cc, more preferably less than about 1.8 g/cc, and most preferably less than about 1.7 g/cc; however numerous other types of lightweight material may be used without departing from the scope and content of the present invention as long as it has a density that is less than that of the material used to form the body portion 102.

One key feature shown in FIG. 1 that is worth highlighting is the parting line 114 between the body portion 102 and the crown portion 110. It should be noted that visually, the parting line 114 is located significantly forward on the crown 111 ledge than any other prior art golf club head 100 incorporating multiple materials, as it follows the visual cue of a golf club head 100 that creates a natural break between the striking face portion 104 and the crown 111. Having this crown parting line 114 being located so far forward is beneficial to the performance of a golf club head in that it eliminates the undesirable visuals generally associated with multi-material golf club head wherein the crown portion 110 is made from a lightweight composite type material. However, having the parting line 114 between the crown portion 110 and the body portion 102 this far forward in the crown portion of the golf club head 100 comes with additional design challenges that will be discussed below.

Figure 2:
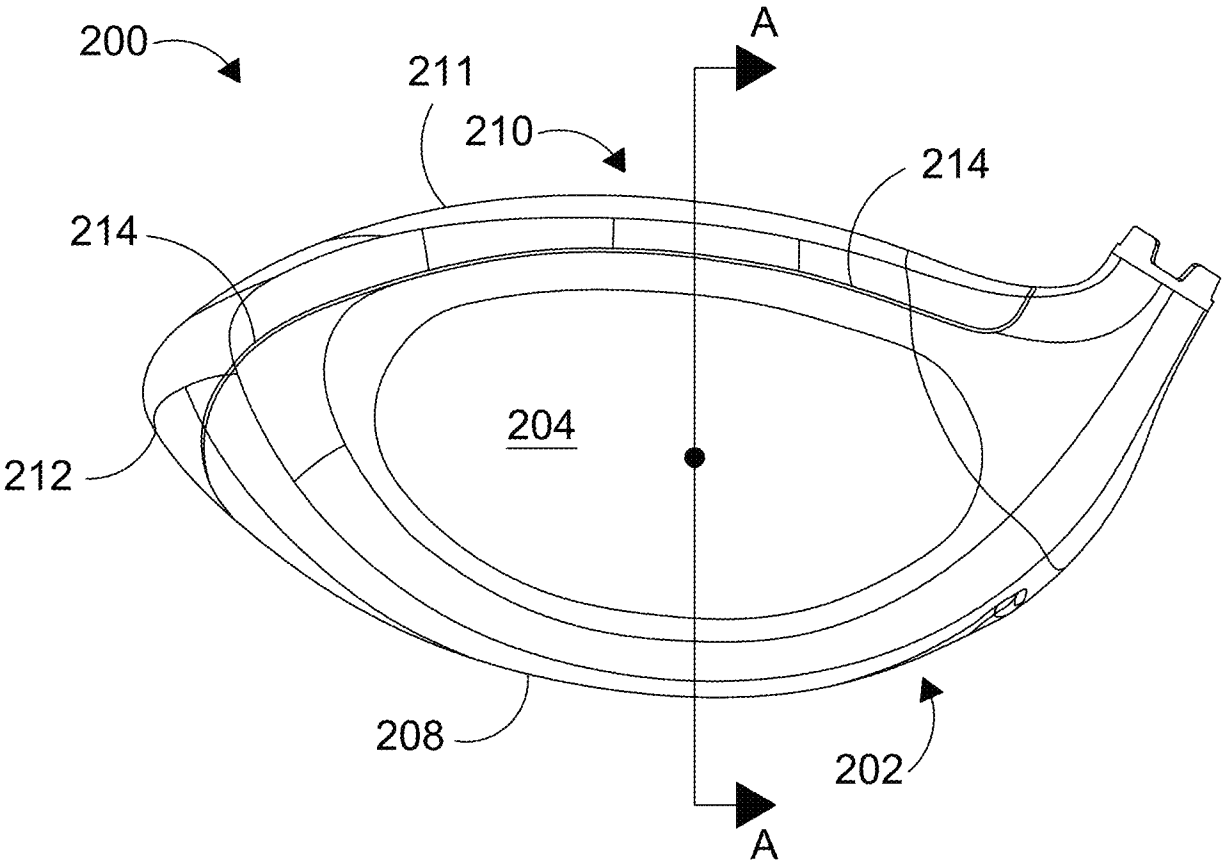
FIG. 2 of the accompanying drawings shows a frontal view of a golf club head in accordance with an exemplary embodiment of the present invention.

FIG. 2 of the accompanying drawings shows a frontal view of a golf club head 200 in accordance with an exemplary embodiment of the present invention. The frontal view of this golf club head 200 shows the body portion 202 forming a portion of the sole 208 and the crown portion 210 forming a crown 211 and a skirt 212 of the golf club head 200. In addition to the above, this frontal view also allows the parting line 214 to be shown more clearly, once again illustrating that the location of the parting line 214 that separates the crown portion 210 from the sole portion 202 follows the contour of the upper edge of the striking face 204 in the striking face plane, and transitions towards to a line that is underneath the skirt 212 of the golf club head. Finally, this frontal view of the golf club head 200 shown in FIG. 2 also illustrates a cross-sectional line A-A', to which a subsequent cross-sectional view figure can be provided to illustrate the bond between the crown portion 210 and the body portion 202.

Figure 3:
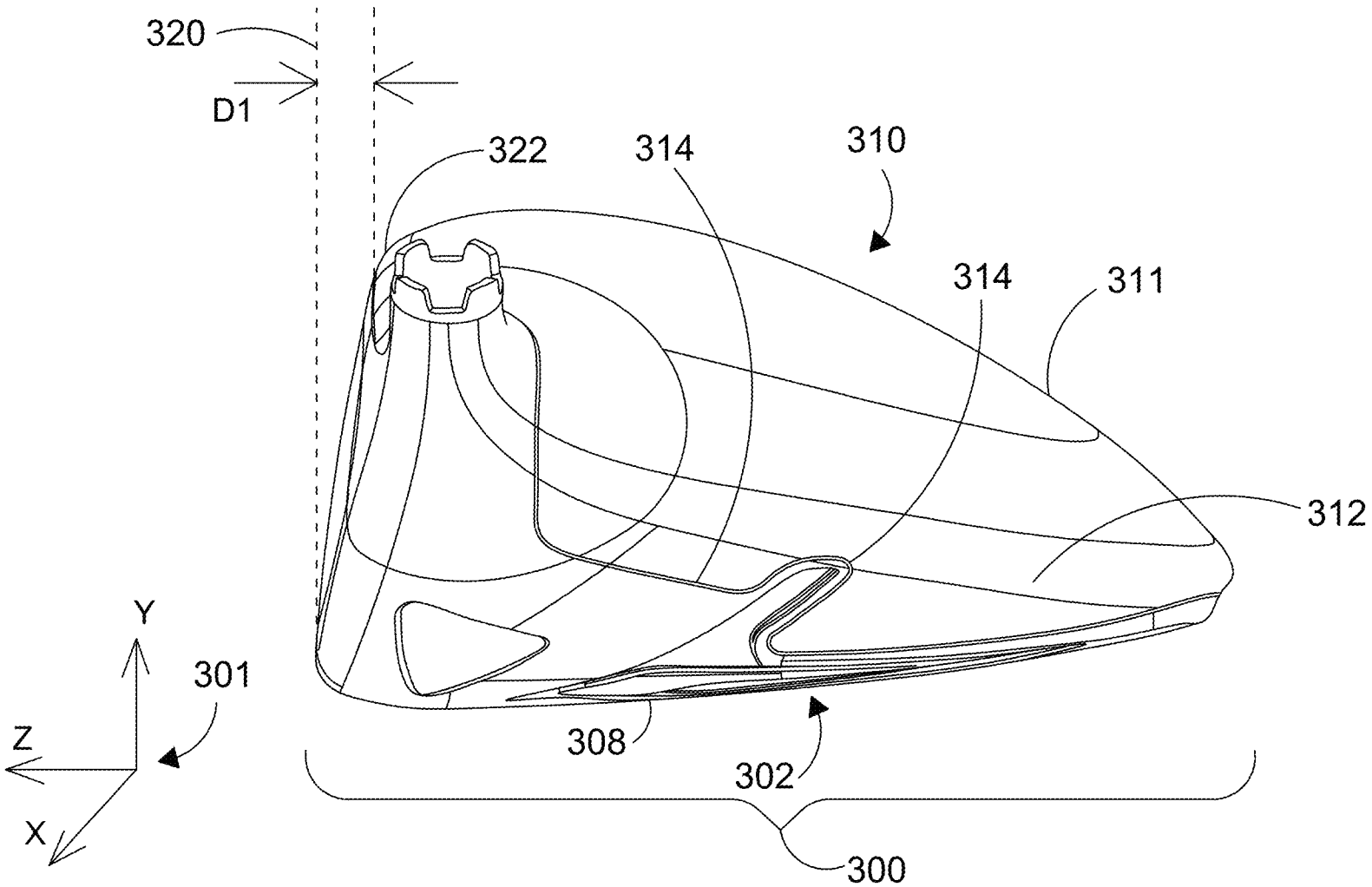
FIG. 3 of the accompanying drawings shows a heel side view of a golf club head in accordance with an exemplary embodiment of the present invention.

FIG. 3 of the accompanying drawing shows a heel side view of a golf club head 300 in accordance with an embodiment of the present invention. In this view, we can once again see the main components of the crown portion 310 further comprising the crown 311 of the golf club head 300 and the body portion 302 further comprising a sole 308 of the golf club head 300. In this heel side view of the golf club head 300 shown in FIG. 3, it can be seen that the parting line 314 falls below the skirt 312 of the golf club head 300 to form a portion of the sole 308. The parting line 214 (shown in FIG. 2), in the frontal view shown in FIG. 2 follows the natural visual cue of the topline of the striking face 204 (shown in FIG. 2), but in the side view shown here in FIG. 3, it actually follows the natural cues derived from the sole 308 graphics as it wraps around the skirt 312 of the golf club head 300 into the sole 308.

Although the details of the bond between the crown portion 310 and the body portion 302 is not shown here in FIG. 3 and will be discussed in more detail in the subsequent cross-sectional views, it is worth noting there that the bond is generally achieved via a lap joint type of joint, wherein there is a beginning of an overlap and an end of an overlap. This key concept will be used to help define distance D1 below, as distance D1 is critical to the present invention in providing the improved aesthetic performance of the present invention.

In addition to the above FIG. 3 of the accompanying drawings also shows another key feature of the present invention by illustrating the forwardmost vertical plane 320. The forwardmost vertical plane 320 is a plane that is created in the x-y plane as illustrated by the coordinate system 301 that abuts the forwardmost portion of the golf club head 300. Often in a conventional golf club head 300 geometry, the forwardmost plane 320 abuts the leading edge of the face sole junction; however, in alternative embodiments of the present invention, the forwardmost plane 320 could abut any other location in the golf club head 300 without departing from the scope and content of the present invention so long as it fits the definition above.

Once the forwardmost vertical plane 320 is established, another very important distance D1 could be illustrated. Distance D1, as defined in the present invention, relates to the distance between the forwardmost vertical plane 320 and the forwardmost point 322 of said crown portion 310. In the current embodiment of the present invention, distance D1 may generally be less than about 17.5 mm, more preferably less than about 16.5 mm, and most preferably less than about 15.5 mm. This distance D1, as previously mentioned, is critical to the proper function of the present invention as it allows the parting line 314 between the crown portion 310 and the body portion 302 to be shifted to an existing visual cue that already exists in a golf club head 300 such as the crown topline transition. The ability to strategically place the parting line 314 of the different components of a multi-material golf club head 300 at a location that fits with an existing visual cue of a golf club head 300 is beneficial to the performance of a golf club head 300 in that it minimizes visual distractions of a golf club head that can often be undesirable.

Figure 4:
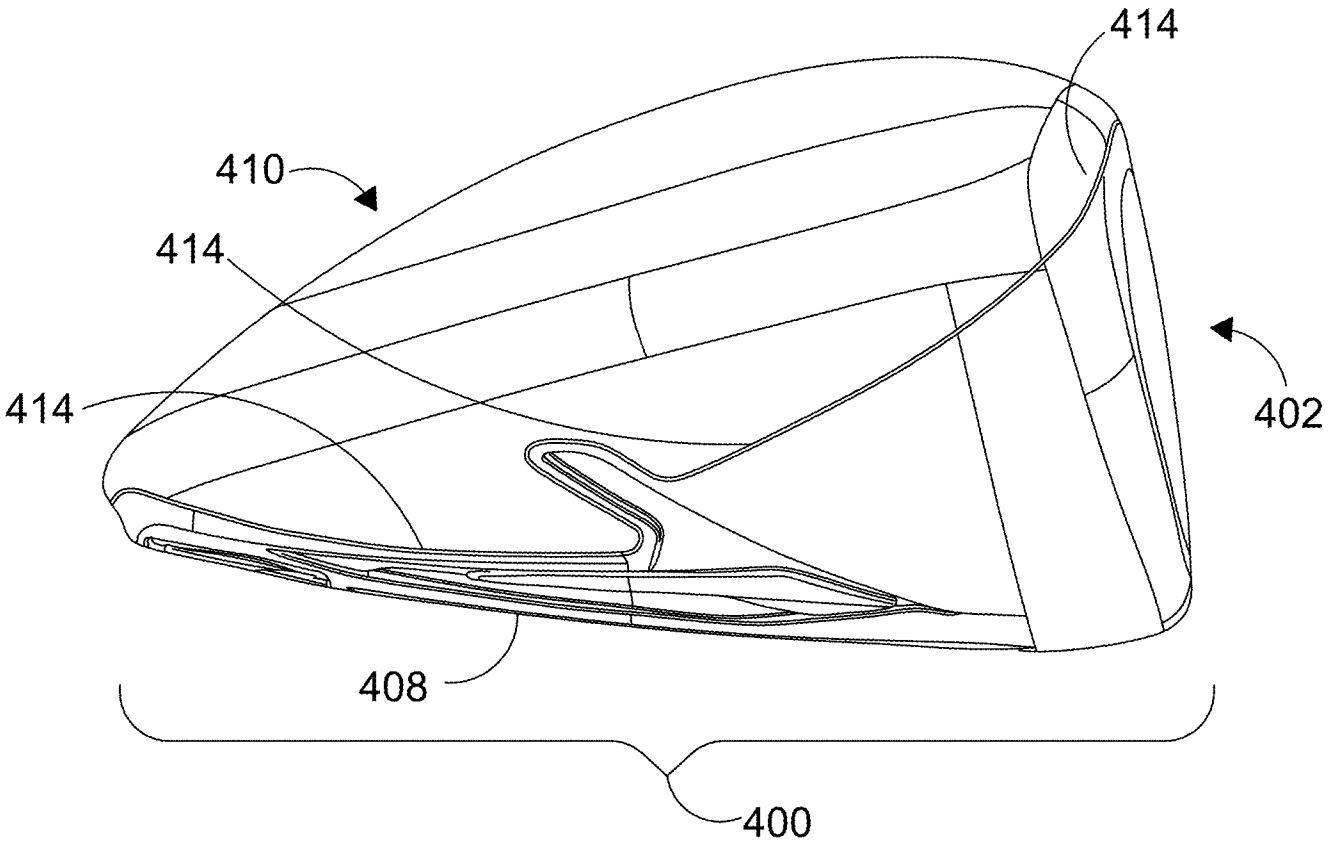
FIG. 4 of the accompanying drawings shows a toe side view of a golf club head in accordance with an exemplary embodiment of the present invention.

Before moving on to a discussion about the undesirable visual generally associated with a prior art multi-material golf club head 500 (shown in FIG. 5), FIG. 4 of the accompanying drawings merely shows a toe side view of a golf club head 400 in accordance with an embodiment of the present invention, allowing the parting line 414 between the crown portion 410 and the body portion 402 to be shown more clearly. Although the parting line 414 shown in FIG. 4 mostly mirrors the parting line 314 (shown in FIG. 3) due to the fact that the sole 408 is symmetrical in terms of its graphics, the hosel portion of the parting line 414 is slightly different as shown in FIG. 3 due to the fact that only one side of a golf club head 400 has a hosel.

Figure 5:
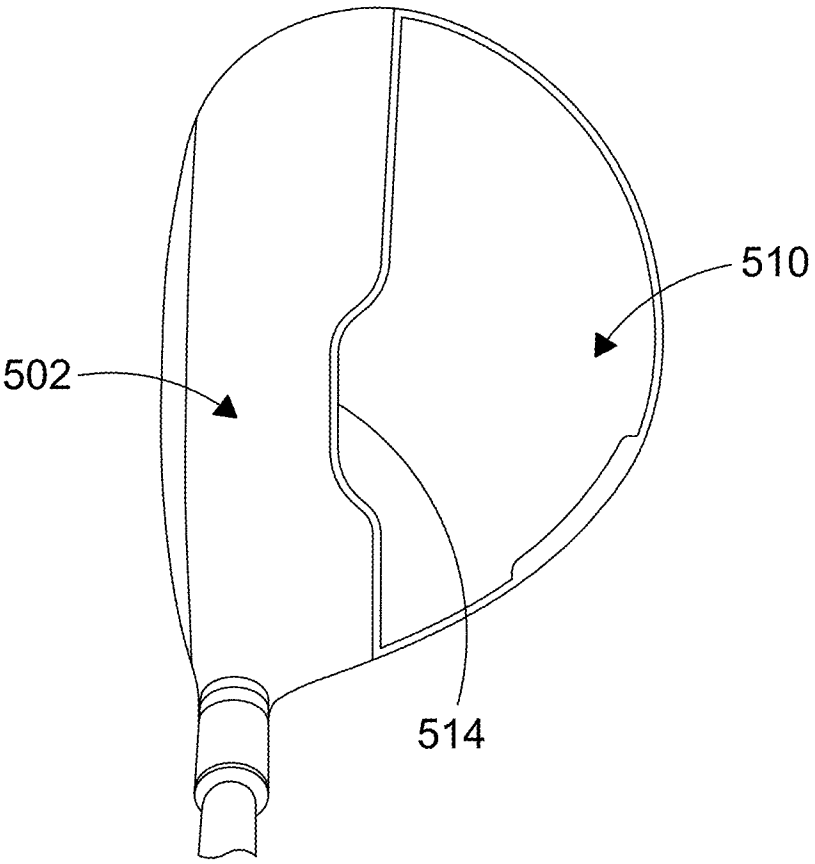
FIG. 5 (Prior Art)
FIG. 5 of the accompanying drawings shows a top crown view of a prior art golf club head.

FIG. 5 of the accompanying drawings shows a top view of a prior art golf club head 500 where no effort is made to strategically align the parting line 514 between the crown portion 510 with the body portion 502 with any existing visual cue or natural feature of the golf club head 500. As it can be seen in FIG. 5, the resultant golf club head 500 leaves a strange line across the crown of the golf club head 500, creating an undesirable and distracting effect that will be distracting to a golfer.

Figure 6:
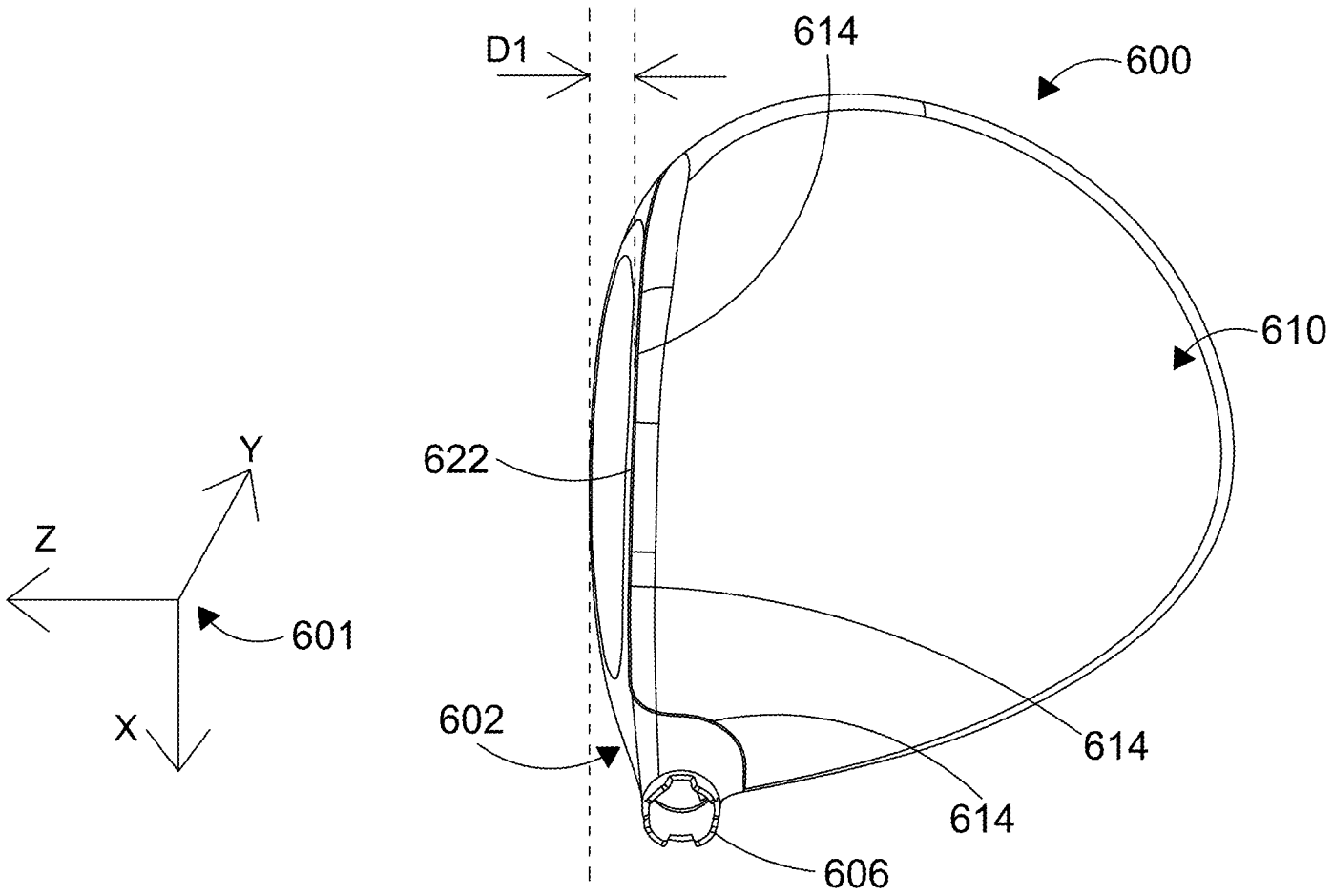
FIG. 6 of the accompanying drawings shows a top crown view of a golf club head in accordance with an exemplary embodiment of the present invention.

Comparing the top view of the prior art golf club head 500 shown in FIG. 5 with the top view of the current inventive golf club head 600 shown in FIG. 6, golf club head 600 provides an improved performance in the visuals of the golf club head 600 by shifting the parting line 614 to the frontal crown transition portion defined as the forwardmost point of said crown portion 610 in FIG. 6. It is worth noting here that despite the best efforts to create a seamless parting line 614 that matches with an existing visual cue of a golf club head 600, the parting line 614 does become more visually recognizable around the hosel 606 of the golf club head 600; as that region of the golf club head 600 does not contain any discernable visual cues that lend itself well to conceal the parting line 614. In addition to showing the improvement in the aesthetics of the golf club head 600 compared to prior art golf club head 500 (shown in FIG. 5), FIG. 6 of the accompanying drawings once again shows the distance D1, being measured from the forwardmost portion of the golf club head 600 to the forwardmost point 622 of the crown portion, along the z-axis.

Figure 7:
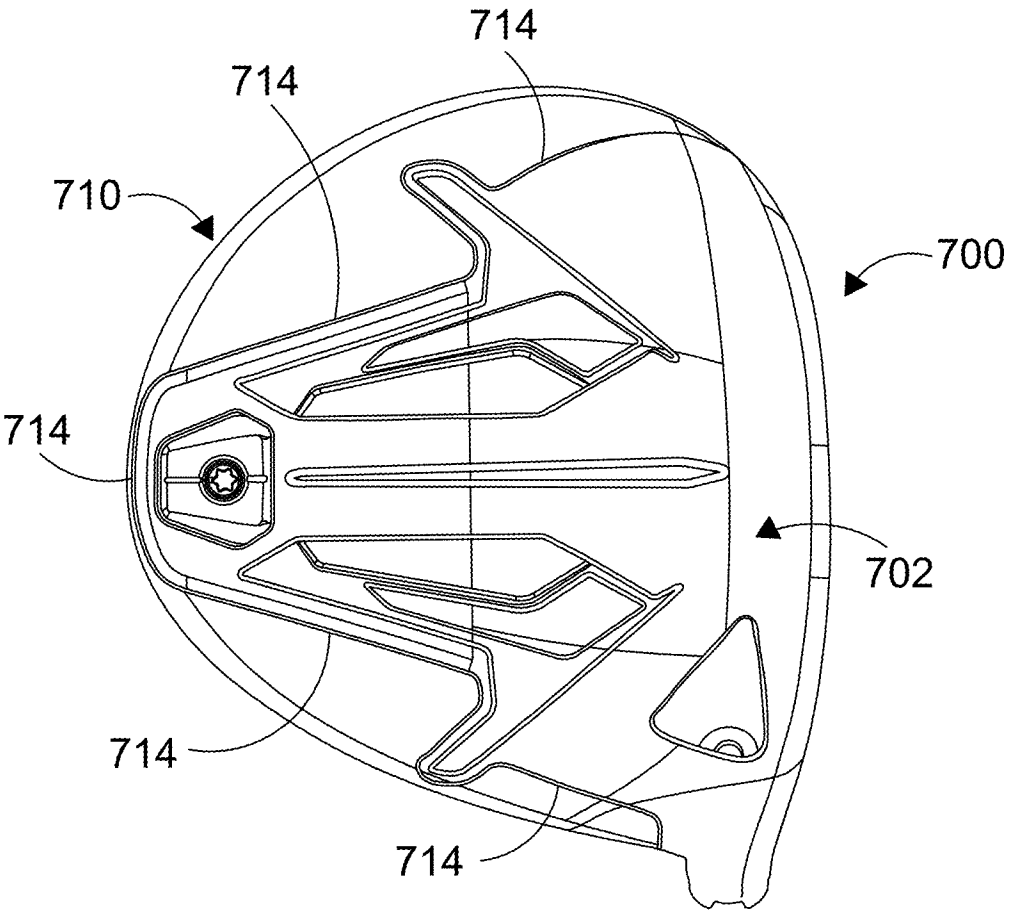
FIG. 7 of the accompanying drawings shows a bottom sole view of a golf club head in accordance with an exemplary embodiment of the present invention.

FIG. 7 of the accompanying drawings shows a bottom sole view of a golf club head 700 in accordance with an embodiment of the present invention. In this sole view of the golf club head 700 we can see that the parting line 714 follows the visual cues of the sole graphics, allowing the golf club head 700 to create a visually seamless blend between the crown portion 710 and the body portion 702. In addition to the above, this bottom sole view of the golf club head 700 illustrates how the crown portion 710 wraps around a skit of the golf club head 700 to form at least a portion of the sole of the golf club head 700.

Figure 8:
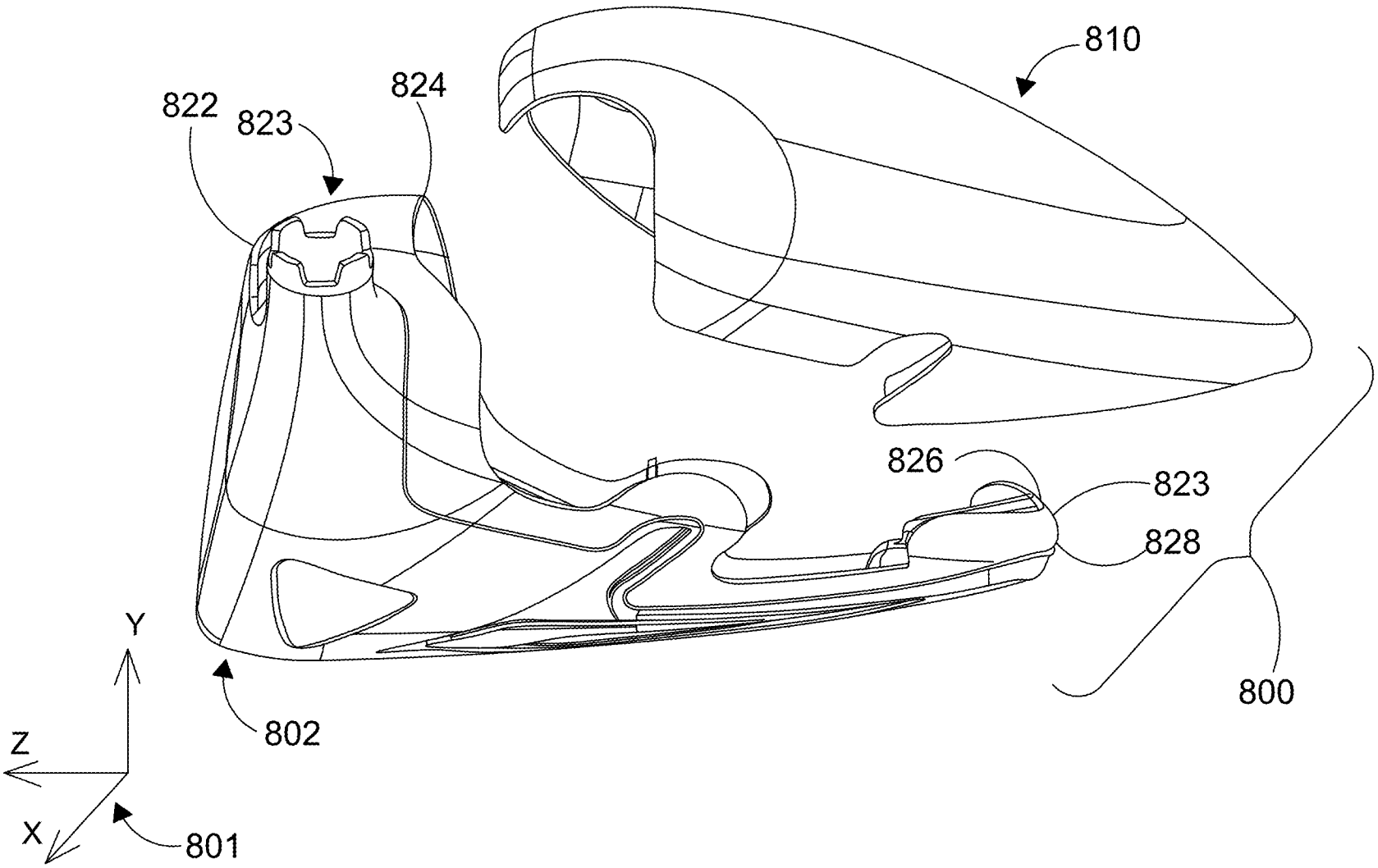
FIG. 8 of the accompanying drawings shows an exploded heel side view of a golf club head in accordance with an exemplary embodiment of the present invention.

FIG. 8 of the accompanying drawings shows an exploded view of a golf club head 800 in accordance with an embodiment of the present invention. In this exploded view of the golf club head 800 shown in FIG. 8, one can clearly how the crown portion 810 and the body portion 802 fit together via a lap joint as previously discussed. Although the cross-sectional view of the golf club head will provide even more detail below, the body portion 802 has a recess 823 around the perimeter of the body portion 802. The recess 823, shown in FIG. 8 is generally created to accommodate the thickness of the crown portion 810 at the various portions around the perimeter of the body portion 802, allowing the two components to bond together via a lap joint type of bond. However, in alternative embodiments of the present invention, other types of bonds such as a butt joint, a dado joint, a rabbet joint, a dovetail joint, a tongue and groove joint, or any other types of joint could be used so long as it is capable of joining the crown portion 810 to the body portion 802 all without departing from the scope and content of the present invention.

The exploded view of the golf club head 800 shown in FIG. 8 also illustrates another critical feature of the present invention, wherein the distance of the overlap between the crown portion 810 with the body portion 802 to form said recess 823 varies across different portions of the golf club head 800 depending on the unique bonding requirements at each location. Because the present invention shifts the location of the parting line around various parts of the golf club head 800 to accommodate for visual cues inherent within a golf club head 800, the bond strength required at the various portions of the golf club head 800 may be different, requiring different amount of overlap. This amount of overlap, generally quantified as the length of a recess 823 is generally defined as the distance between the beginning of an overlap to the end of an overlap. For the frontal crown joint recess 823 length, that length is defined as the difference between the forwardmost point 822 of the crown portion 810 and the rearward most point 824 of the recess 823 at the frontal body portion 802. For the aft rear joint recess length, that length is defined as the difference between the rearwardmost point 828 of the crown portion 810 and the forwardmost point 826 of the recess 823 at the rear of the body portion 802.

Figure 9:
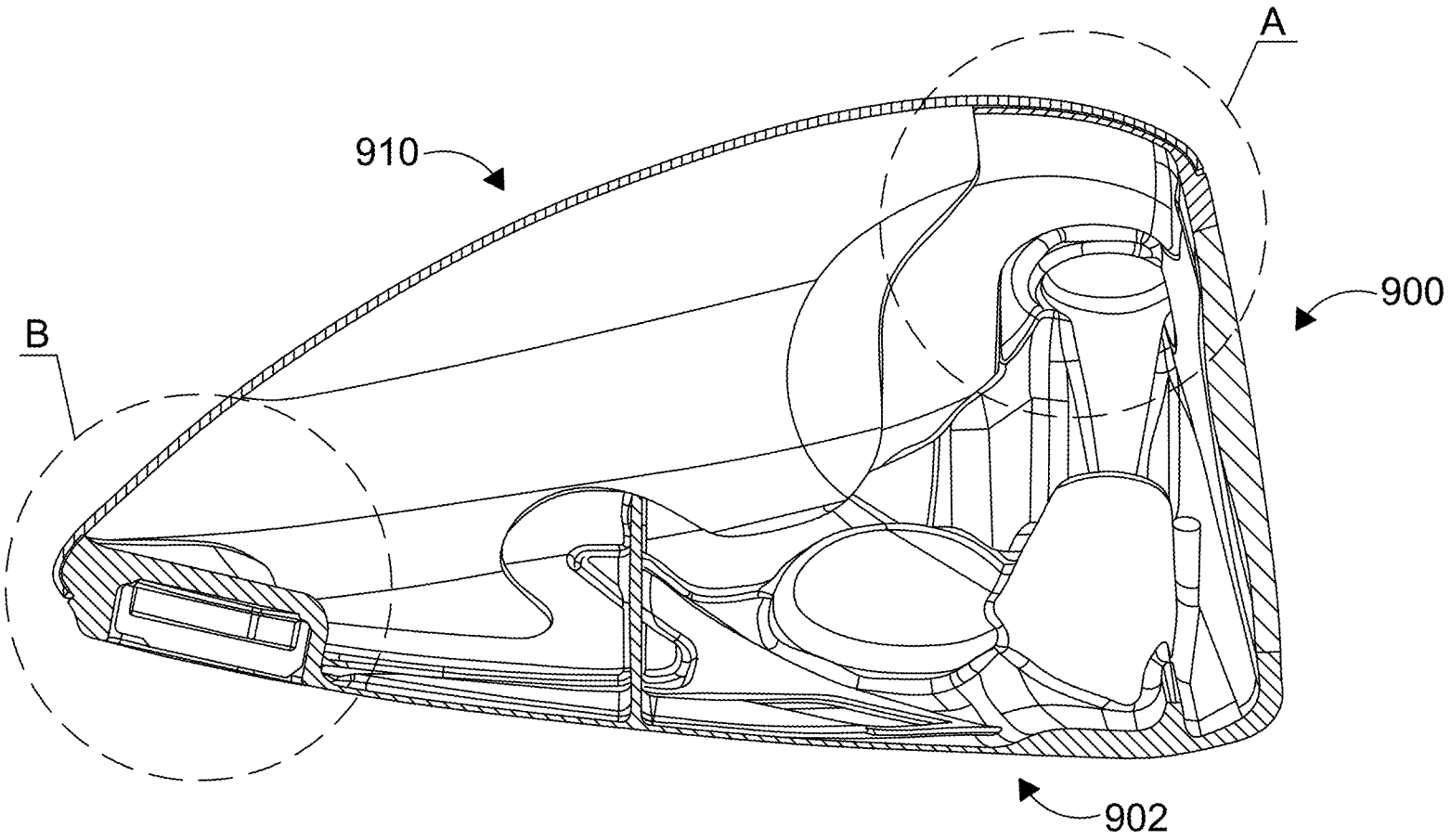
FIG. 9 of the accompanying drawings shows a cross-sectional view of a golf club head in accordance with an exemplary embodiment of the present invention, taken along cross-sectional line A-A' shown in FIG. 2.

In order to illustrate this very important concept of creating and defining a recess 823 via the overlap, a cross-sectional view of the golf club head 900 is shown in FIG. 9. This cross-sectional view of the golf club head 900 shown in FIG. 9 is taken along cross-sectional line A-A' shown in FIG. 2, down the center of the golf club head. In this cross-sectional view of the golf club head 900 the crown portion 910 is attached to the body portion 902 via overlapping lap joints created by recesses in the body portion 902. Circular region A and circular region B are also highlighted in FIG. 9, allowing enlarged views of the crown leading edge recess and the aft portion recess to be shown in more detail in FIGS. 10 and 11 respectively, illustrating the different designs used to achieve the different bonds at different portions of the golf club head 900.

Figure 10:
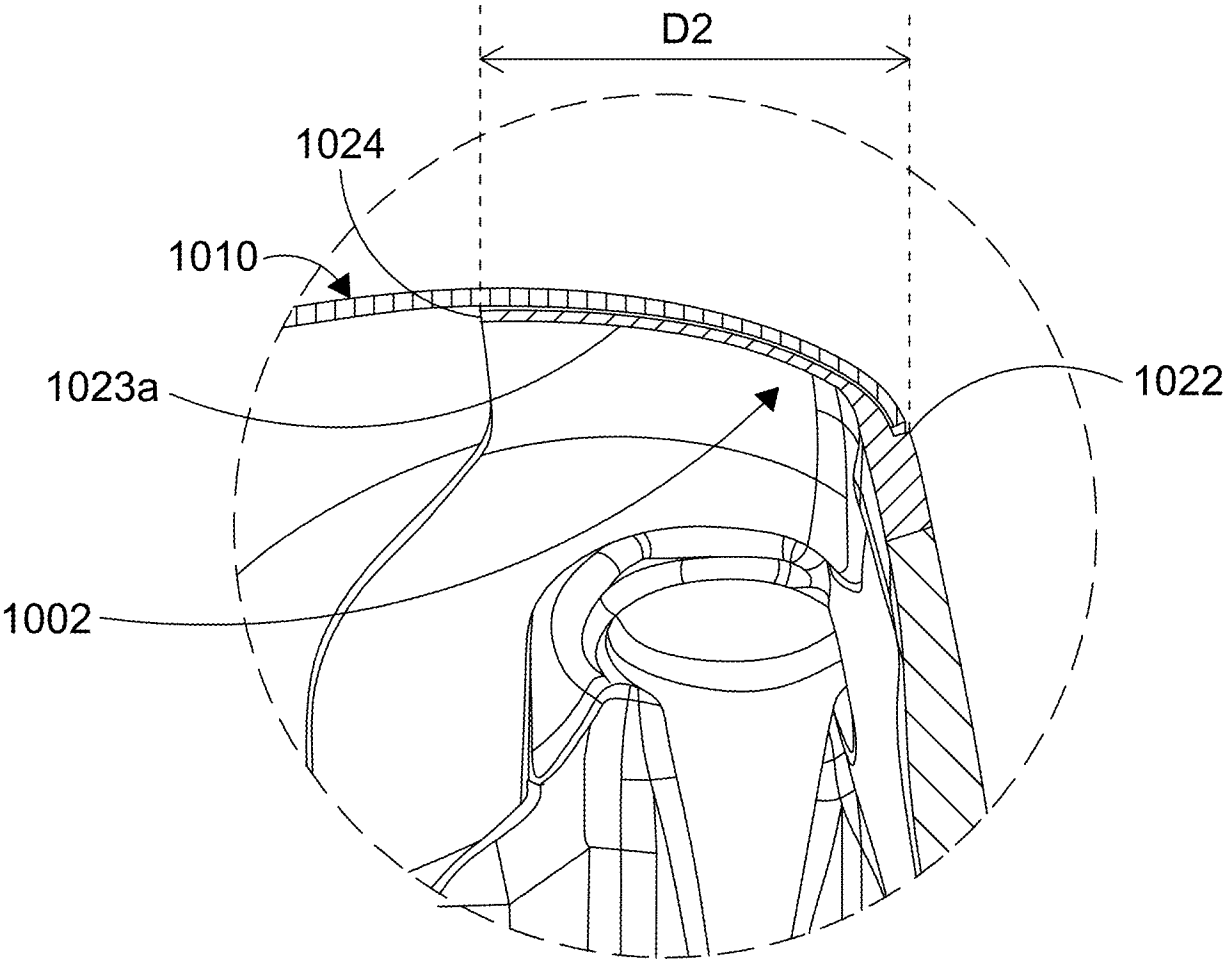
FIG. 10 of the accompanying drawings shows an enlarged cross-sectional view of a golf club head highlighted by circular region A shown in FIG. 9.

FIG. 10 of the accompanying drawings shows an enlarged cross-sectional view of circular region A shown in FIG. 9, which reflects an enlarged cross-sectional view of a frontal crown junction point between the crown portion 1010 and the body portion 1002. Although it's been discussed briefly in earlier discussions, the bond between the crown portion 1010 and the body portion 1002 is generally achieved via an overlapping lap joint type of bond, with the body portion 1002 forming a frontal crown recess 1023*a* to receive the crown portion 1010. The thickness of the frontal crown recess 1023*a* in accordance with the present invention may generally be less than about 1.0 mm, more preferably less than about 0.9 mm, and most preferably less than about 0.8 mm, as crown portion 1010 is typically made from a thin lightweight composite type material. This thickness of the frontal crown recess 1023*a* may generally be thicker than the actual thickness of the crown portion 1010 itself, because not only does it need to accommodate the thickness of the crown portion 1010 in the range of less than about 0.8 mm, more preferably less than about 0.7 mm, and most preferably less than about 0.65 mm, it also has to accommodate approximately 0.15 mm of glue bond thickness that is not shown in FIG. 10. In this enlarged view shown in FIG. 10, because the bond between the crown portion 1010 and the body portion 1002 at the crown leading edge is so close to the striking face plane, it has an increased overlap length to accommodate for the increased stress occurring at that portion of the golf club head. This overlap length D2, although may look like a linear length in FIG. 10, is actually an arc length, but only appears linear due to the large radius of curvature at this portion of the golf club head. The increased overlap length at the crown transition, defined here as frontal crown transition overlap length D2, may generally be greater than about 12 mm and less than about 25 mm, more preferably greater than about 13 mm and less than about 24 mm, and most preferably greater than about 14 mm and less than about 23 mm. The frontal crown transition overlap length D2, as described in the present invention, may generally start at the forwardmost point 1022 of the crown portion 1010 and end at the rearwardmost point 1024 of the frontal crown recess 1023*a* at the front of the body portion 1002.

Figure 11:
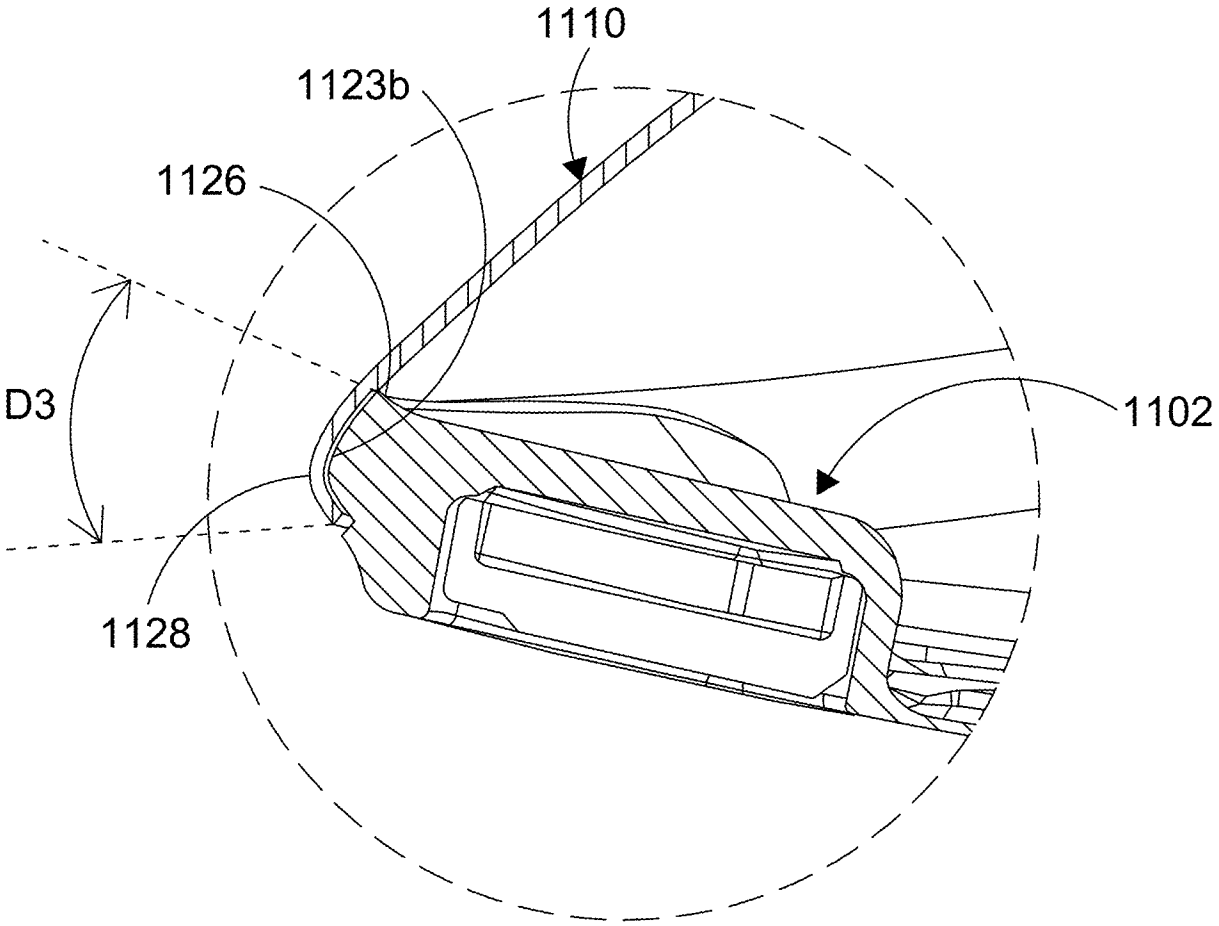
FIG. 11 of the accompanying drawings shows an enlarged cross-sectional view of a golf club head highlighted by circular region B shown in FIG. 10.

FIG. 11 of the accompanying drawings shows an enlarged cross-sectional view of circular region B shown in FIG. 9, which reflects an enlarged cross-sectional view of a rear sole junction point between the crown portion 1110 and the body portion 1102. Although this geometry may look more complicated at the rear portion of the golf club head due to the adjacent weighting member, the overall concept of the bond here remains the same with an overlapping lap joint created via a rear sole recess 1123*b* in rear of the body portion 1102. Similar to the discussion above, the thickness of the rear sole recess 1123*b*, because it is adapted to receive the same crown portion 1110, is generally less than about 1.0 mm, more preferably less than about 0.9 mm, and most preferably less than about 0.8 mm. However, in this rear portion of the golf club head, because of the rear edge is not subjected to as much impact stresses at the crown leading edge, the overlap length does not need to be as lengthy. The rear overlap length D3, in accordance with the current embodiment of the present invention, may generally be less than about 6.5 mm, more preferably less than about 6 mm, and most preferably less than about 5 mm. The rear overlap length D3, as described in the present invention, may generally be the difference between the rearwardmost point 1128 of the crown portion 1110 and the forwardmost point 1126 of the rear sole recess 1123*b* at the rear of the body portion 1102 taken along the arc, and not just linearly.

In view of the dramatic difference in the crown transition overlap length D2 and the rear overlap length D3, it can be said that the present golf club head has a Ratio of Front to Rear Overlap Length of about greater than about 2.0, more preferably greater than about 2.5, and most preferably greater than about 3.0. The Ratio of Front to Rear Overlap Length defined by Equation (1) below:

$$\text{Ratio of Front to Rear Overlap Length} = \frac{\text{Crown transition overlap length } D2}{\text{Rear overlap length } D3} \quad \text{Eq. (1)}$$

Figure 12:
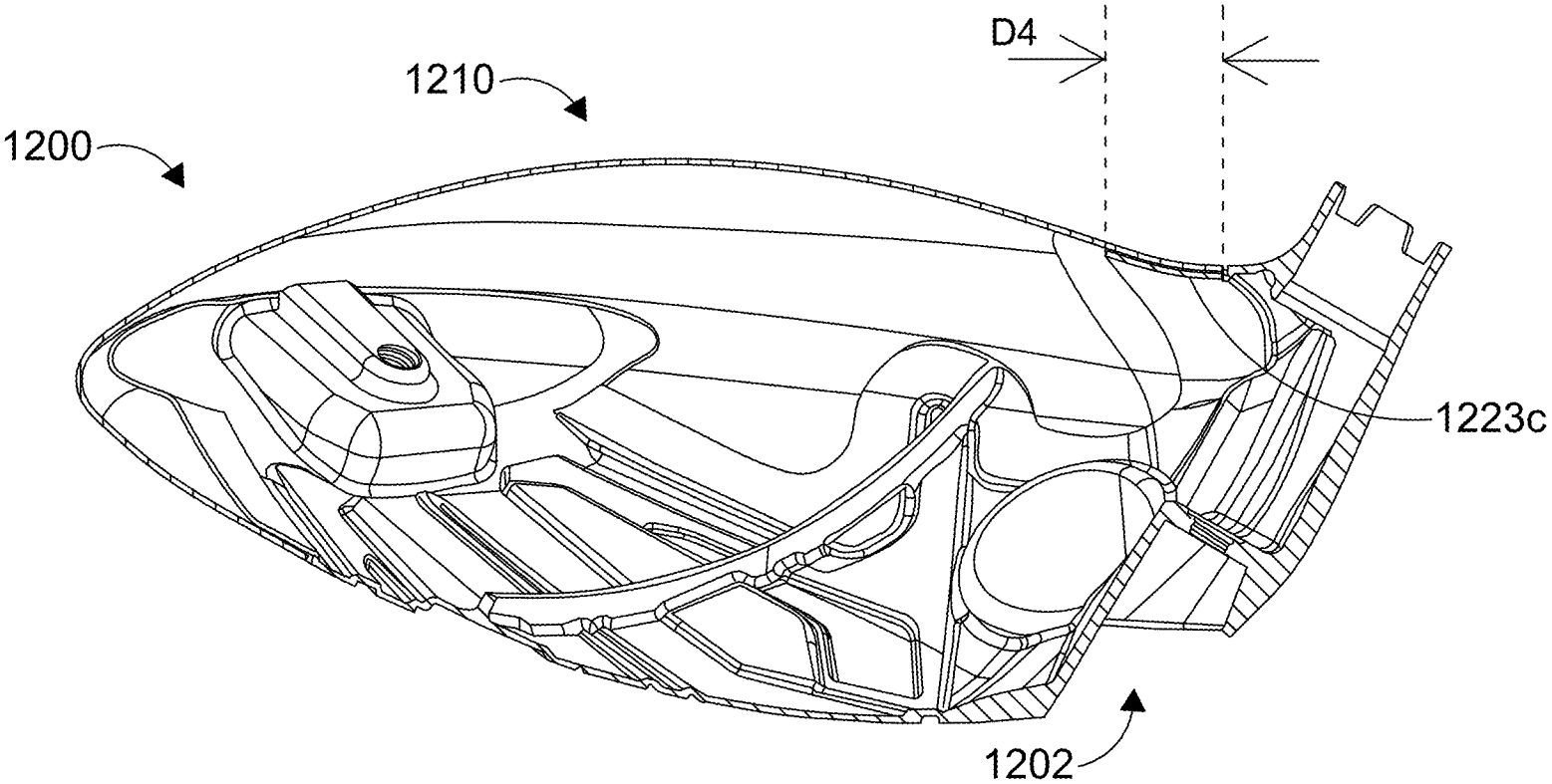
FIG. 12 of the accompanying drawings shows a cross-sectional view along a different cross-sectional line allowing the hosel portion recess to be shown more clearly.

FIG. 12 of the accompanying drawings shows a cross-sectional view of the golf club head 1200 in accordance with an exemplary embodiment of the present invention. In this cross-sectional view of the golf club head 1200 shown in FIG. 12, we can see that the distance of the hosel portion recess 1223*c* between the crown portion 1210 and the body portion 1202 has an hosel overlap length D4 of greater than about 8 mm, more preferably greater than about 9 mm, and most preferably greater than about 10 mm. This length D4 is shown to be taken at an angle of 45° offset from the hosel axis, but could be measured from any angle that is between 15° to about 75° all without departing from the scope and content of the present invention. Moreover, the measurement of length D4 above is generally a measurement of the arc length as previously mentioned, despite it looking like a linear measurement in FIG. 12. Finally, similar to the discussion above, a separate ratio of Hosel to Rear Overlap Length may be established by Equation (2) below, defining the relationship between the two components.

$$\text{Ratio of Hosel to Rear Overlap Length} = \frac{\text{Hosel transition overlap length } D4}{\text{Rear overlap length } D3} \quad \text{Eq. (2)}$$

The Hosel to Rear Overlap Ratio Length, in accordance with the present invention, may generally be greater than about 1.0, more preferably greater than about 1.5, and most preferably greater than about 2.0

Figure 13:
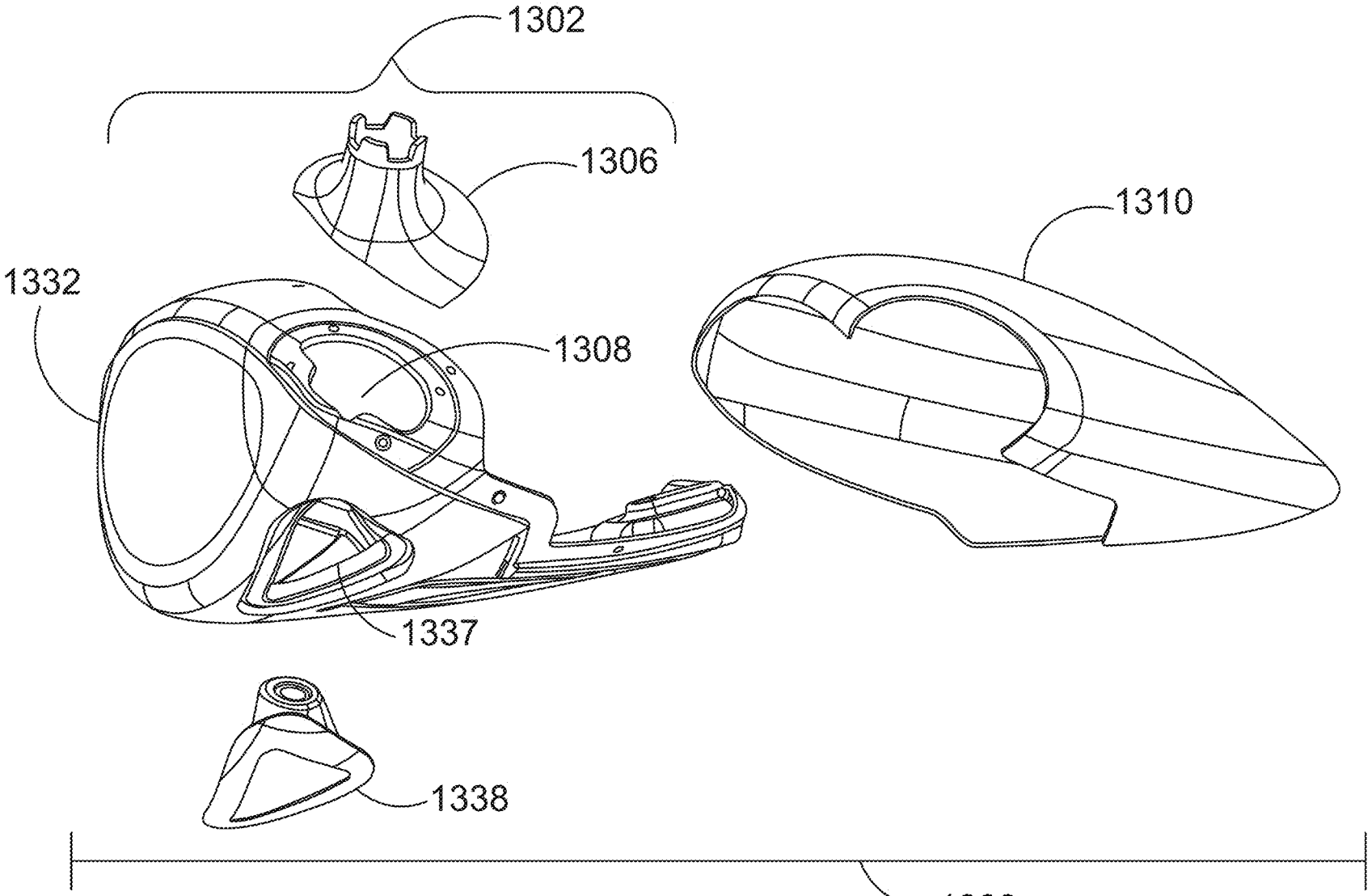
FIG. 13 of the accompanying drawings shows an exploded perspective view of a golf club head in accordance with an even further alternative embodiment of the present invention.

FIG. 13 of the accompanying drawings shows an exploded perspective view of a golf club head 1300 in accordance with a further alternative embodiment of the present invention. In this alternative embodiment of the present invention shown in FIG. 13, we can see that the golf club head 1300 is still comprised out of two main components, the body portion 1302 and the crown portion 1310 similar to previous discussions. However, in this alternative embodiment of the present invention, the metallic body portion 1302 is now formed out of three components, a main body chassis 1332, an upper hosel component 1306 and a lower hosel component 1338. The main body chassis 1332 may have an upper hosel opening 1305 and a lower hosel opening 1337, adapted to engage the upper hosel component 1306 and the lower hosel component 1338 respectively. The upper hosel component 1306 and the lower hosel component 1338 are generally formed independently and separately from the main body chassis 1332 and could even be formed out of different material to achieve different properties in the golf club head 1300 all without departing from the scope and content of the present invention.

The upper hosel component 1306 shown in this embodiment of the present invention may generally be made out of a lightweight polymer such as Kyronmax® S-2212 type of material from Mitsubishi Chemicals for it's lightweight and high strength properties. However, in alternative embodiments, the upper hosel component may also be made out of stainless steel, aluminum, titanium, or even theoretically tungsten all without departing from the scope and content of the present invention. Making the upper hosel component 1306 separately from the main body chassis 1332 reduces the machining needs to be done directly to the main body chassis 1332 and streamlines the manufacturing of this upper hosel component 1306.

The lower hosel component 1338 show in this embodiment of the present invention may generally be made out of stainless steel material for its ability to lower and move forward the center of gravity, which is often a desirable location for the center of gravity of a golf club head 1300. However, in alternative embodiments of the present invention, the lower hosel component 1338 may also be made out of aluminum, titanium, tungsten, or even the lightweight Kyronmax® S-2212 material mentioned above should it be helpful in achieving the desired CG location. Similar to the upper hosel component 1306 discussed above, making the lower hosel component 1338 separately also reduces the machining needs that needs to be done directly to the main body chassis 1332 and streamlines the manufacturing of the lower hosel component 1338 as well.

In addition to the benefit in manufacturing indicated above by removing the upper hosel component 1306 and the lower hosel component 1338 from the main body chassis 1332 to be formed out of the same component irrespective of the desired loft or dexterity of the golf club head, and only the crown portion 1310 and/or the upper hosel component 1306 and/or the lower hosel component 1338 needs to be changed to accomplish the variety of golf club heads throughout the entire line. In addition to the above, in an even further alternative embodiment, the upper hosel component 1306 and the lower hosel component 1338 could even engage differing main body chassis 1332 having different lofts to expand the applicability of these sub-components to different club heads all without departing from the scope and content of the present invention. Finally, more detail regarding golf club heads 1300 having multiple components such as upper hosel component 1306 and lower hosel component 1338 could be found in U.S. patent application Ser. No. 18/075,642, filed on Dec. 6, 2022, the disclosure of which is incorporated by reference in its entirety.

It should be noted that most of the embodiments discussed here aims to create a releasable hosel hole cover, however, all of these embodiments may include glue to make the hosel hole cover stay within the hosel hole, removing the ability to remove the hosel hole cover without departing from the scope and content of the present invention.

Other than in the operating example, or unless otherwise expressly specified, all of the numerical ranges, amounts, values and percentages such as those for amounts of materials, moment of inertias, center of gravity locations, loft, draft angles, various performance ratios, and others in the aforementioned portions of the specification may be read as if prefaced by the word "about" even though the term "about" may not expressly appear in the value, amount, or range. Accordingly, unless indicated to the contrary, the numerical parameters set forth in the above specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

It should be understood, of course, that the foregoing relates to exemplary embodiments of the present invention and that modifications may be made without departing from the spirit and scope of the invention as set forth in the following claims.

What is claimed is:

1. A golf club head comprising:

a body portion further comprising;

a striking face portion that defines a forwardmost vertical plane along the z-axis that abuts the leading edge of a face sole junction when the golf club is in the address position, a main body chassis having a sole portion, wherein said main body chassis forms a rearwardmost point of said golf club head, wherein said main body chassis further comprises a recess around a perimeter of said main body chassis, said recess further comprises;

a frontal crown recess, wherein said frontal crown recess defines a crown transition overlap length, wherein said crown transition overlap length is greater than about 12 mm and less than about 25 mm, a rear sole recess, wherein said rear sole recess defines a rear overlap length, wherein said rear overlap length is less than about 6.5 mm, a crown portion wrapping around a skirt of said golf club head, forming at least a portion of said sole;

wherein a perimeter of said crown portion forms a parting line, separating said crown portion from said body portion, wherein said crown portion overlaps said body portion at said recess of said body portion, wherein said parting line at least partially falls below said skirt, wherein said crown portion has a first density and said body portion has a second density, wherein said first density is less than said second density, and wherein a forwardmost point of said crown portion is located less than about 17.5 mm away from said forwardmost vertical plane.

2. The golf club head of claim 1, wherein said rear overlap length is less than about 6.0 mm.

3. The golf club head of claim 2, wherein said rear overlap length is less than about 5.0 mm.

4. The golf club head of claim 1, wherein said crown portion is made from a material having a density of less than about 2.0 g/cc.

5. The golf club head of claim 4, wherein said body portion is made from a material having a density of about 4.5 g/cc.

* * * * *